US007984860B2

(12) United States Patent
Liao et al.

(10) Patent No.: US 7,984,860 B2
(45) Date of Patent: Jul. 26, 2011

(54) REGULATION CONTROL SYSTEM OF AIR CONDITIONING EQUIPMENT

(75) Inventors: Shiue-Juan Liao, Taipei (TW); Chun-Hung Huang, Taipei (TW); Tsung-Ray Wang, Taipei (TW); Shu-Fen Lin, Taipei (TW); Yu-Huan Wang, Taipei (TW); Chien-Yuan Chen, Taipei (TW)

(73) Assignee: Chunghwa Telecom Co., Ltd., Taipei (TW)

( * ) Notice: Subject to any disclaimer, the term of this patent is extended or adjusted under 35 U.S.C. 154(b) by 451 days.

(21) Appl. No.: 12/179,004

(22) Filed: Jul. 24, 2008

(65) Prior Publication Data

US 2009/0026280 A1 Jan. 29, 2009

(30) Foreign Application Priority Data

Jul. 25, 2007 (TW) ..... 96127038 A

(51) Int. Cl.
*G05D 23/00* (2006.01)
*F24F 11/00* (2006.01)

(52) U.S. Cl. ..... 236/46 R; 236/46 C; 236/51; 62/131; 165/237

(58) Field of Classification Search ..... 62/131; 236/46 R, 46 C, 51, 1 C, 94; 165/237
See application file for complete search history.

(56) References Cited

U.S. PATENT DOCUMENTS

| | | | | |
|---|---|---|---|---|
| 4,035,796 | A * | 7/1977 | Hedly et al. | 236/1 C |
| 4,784,319 | A * | 11/1988 | Kaiser | 236/46 R |
| 4,863,099 | A * | 9/1989 | King et al. | 236/46 R |
| RE33,146 | E * | 1/1990 | Carrell et al. | 165/11.1 |
| 4,948,045 | A * | 8/1990 | Romano | 236/51 |
| 5,476,221 | A * | 12/1995 | Seymour | 236/47 |
| 5,785,243 | A * | 7/1998 | Cross | 236/47 |
| 6,196,468 | B1 * | 3/2001 | Young | 236/46 R |
| 6,745,581 | B2 * | 6/2004 | King et al. | 62/131 |
| 6,840,052 | B2 * | 1/2005 | Smith et al. | 62/126 |

* cited by examiner

*Primary Examiner* — Marc E Norman

(57) ABSTRACT

A regulation control system of air conditioning equipment is provided according to the present invention; the regulation control system mainly interconnects an entrance guarding device and/or a human body movement detecting device with an air conditioning control device, by this way, data of air conditioning usage surroundings condition are generated by the entrance guarding device and/or the human body movement detecting device, and then an air conditioning control device executes regulation and control over the air conditioning equipment based on the data of air conditioning usage surroundings condition with referring to a set of preset regulation parameters; thereby providing the air conditioning equipment with proper regulation and control to operate in preset conditions, and further achieving objective of energy management of the air conditioning equipment.

10 Claims, 3 Drawing Sheets

REGULATION CONTROL SYSTEM OF AIR CONDITIONING EQUIPMENT

BACKGROUND OF THE INVENTION

1. Field of the Invention

This invention generally relates to air conditioning equipment techniques, and more specifically, to a regulation control system of air conditioning equipment, which combines with entrance guarding device and/or human body movement detecting device.

2. Description of Related Art

Air conditioning equipments are very popular applied electronic equipments in various kinds of buildings, especially in large-scale commercial places, such as office buildings, factory buildings, hotels, restaurants, hospitals, supermarkets, wholesale stores, and department stores; a present air conditioning equipment normally includes at least air conditioner heater unit, air handling unit (AHU), precooling air handler (PAH), and fan coil unit (FCU); basically, an air conditioning equipment is capable of adjusting air temperature in an enclosed room to a pleasant condition for people to stay inside as well as taking in proper outdoor fresh air to avoid discomfort and danger caused by high levels of carbon dioxide inside a building.

An air conditioning equipment generally operates long hours or even 24 hours a day, energy consumed by the air conditioning equipment depends on factors, such as size of usage space, outdoor temperature, being shaded from sun or not, attendance at a specific time as well as usage pattern.

For instance, according to a newsletter study report issued by Bureau of Energy, Ministry of Economic Affairs, R.O.C. on Jun. 5, 2007, in the study of air conditioner usage pattern on 1177 stores in five counties, including Taipei, Taichung, Tainan, Kaohsiung, and Hualien, 22% of stores had air curtains and automatic doors, 19% of stores had only automatic doors, 21% of stores had only air curtains, and 38% of stores were leaving their doors broadly open; also according to the study report, adding automatic door could save 52% energy consumed, and it was about NTS10,000 (c.a. US$300) saved per 535 square feet per one summer season.

In addition, setting temperature at air conditioning equipment is also a matter of usage pattern, according to an energy statistic report by Ministry of Economic Affairs, R.O.C., raising the preset temperature one Celsius degree up could save 6% consumed energy.

Obviously, the abovementioned air conditioning equipments of one-way control are capable of lowering down consumed energy by utilizing entrance guarding at usage surroundings of the air conditioning equipments, raising preset temperature, and saving energy thus; as a matter of fact, condition of entrance guarding and the setting of temperature are closely related.

Specifically, if the usage surroundings of an air conditioning equipment is installed with entrance guarding device, and the entrance guarding device includes, more specifically, automatic door for people to get in and go out as well as window exhaust fan; there are many factors that will cause the entrance guarding device open, such as when someone forgets to close the door, does not close it properly, or intentionally leave the door open; according to prior air conditioning equipments, in order to control temperature of usage surroundings of an air conditioning equipment to be at a preset temperature, wind speed and/or compressor operation mechanism must be increased when the entrance guarding device is open and hot air is led into inside; naturally, increasing wind speed and/or compressor operation mechanism consume more energy.

In fact, sometimes when a user feels it is too cold inside and some outside warm air is welcome, the user might intentionally leave the foresaid entrance guarding device open; since the control system of prior air conditioning equipment is capable of executing air conditioning control process based on a preset temperature only, in a case that user intentionally leaves door open, more energy is definitely unnecessarily consumed and wasted.

Furthermore, in some public places, such as office buildings, schools, and others, air conditioning equipments sometimes keep operating even when there is no occupant inside, thereby causing unnecessary waste of energy; causes of the situation are: users forgot to turn off the air conditioning equipments, users planned to return but didn't, last users thought there were still other users in; the last users didn't know how to turn off the air conditioning equipments.

Hence, it is a highly urgent issue in the industry for how to provide a regulation control system of air conditioning equipment, which is capable of effectively regulating and controlling over air conditioning equipments based on usage condition of entrance guarding devices and/or whether users are inside the usage surroundings of the air conditioning equipments.

SUMMARY OF THE INVENTION

In view of the disadvantages of the prior art mentioned above, it is a primary objective of the present invention to provide a regulation control system of air conditioning equipment, which is capable of regulating and controlling operation of air conditioning equipments based on usage condition of entrance guarding devices.

It is another objective of the present invention to provide a regulation control system of air conditioning equipment, which is capable of regulating and controlling operation of an air conditioning equipment based on whether users are inside the usage surroundings of the air conditioning equipment.

It is a further objective of the present invention to provide a regulation control system of air conditioning equipment, which is capable of regulating and control operation of air conditioning equipment based on usage condition of entrance guarding device and/or whether users are inside the usage surroundings of the air conditioning equipment.

To achieve the aforementioned and other objectives, a regulation control system of air conditioning equipment is provided according to the present invention, which is for regulating and controlling air conditioning equipments; the regulation control system comprises: one entrance guarding device, which is for detecting usage condition of entrance and/or windows, also the entrance guarding device has a timer unit that is for calculating time period of opening/closing at the entrance and/or windows, and then data of air conditioning usage surroundings condition are produced based on detected condition of opening/closing, the data of air conditioning usage surroundings condition include condition and time period of opening/closing at entrance and/or windows; and an air conditioning control device, which includes a storage module that stores a set of preset regulation parameters corresponding to different data of air conditioning usage surroundings condition, and then based on the data of air conditioning usage surroundings condition derived from the entrance guarding device with referring to the preset regulation parameters, the air conditioning control device executes regulation and control over air conditioning equipments.

In another embodiment of the present invention, the regulation control system of air conditioning equipment of the present invention, which is for regulating and controlling air conditioning equipments, further comprises: a human body movement detecting device that is for detecting usage condition that whether users are inside the usage surroundings of the air conditioning equipment, and then based on the detected usage condition, data of air conditioning usage surroundings condition are generated; and an air conditioning control device, which includes a storage module that stores a set of preset regulation parameters corresponding to different data of air conditioning usage surroundings condition, and the air conditioning control device executes regulation and control over the air conditioning equipments based on the data of air conditioning usage surroundings condition derived from the human body movement detecting device with referring to the preset regulation parameters.

In a further embodiment of the present invention, the regulation control system of air conditioning equipment, which is for regulating and controlling air conditioning equipments further comprises: an entrance guarding device, which is for detecting usage condition of entrance and/or windows, and the entrance guarding device also has a timer unit that is for calculate time period of opening/closing at the entrance and/or windows, and then based on detected condition of opening/closing, data of air conditioning usage surroundings condition are generated, the data of air conditioning usage surroundings condition include condition and time period of opening/closing at the entrance and/or windows; a human body movement detecting device, which is for detecting usage condition that whether users are inside the usage surroundings of the air conditioning equipments, and then based on the detected usage condition, data of air conditioning usage surroundings condition are generated; and an air conditioning control device, which includes a storage module that stores a set of preset regulation parameters corresponding to different data of air conditioning usage surroundings condition, and the air conditioning control device executes regulation and control over the air conditioning equipments based on the data of air conditioning usage surroundings condition derived from the entrance guarding device and/or the human body movement detecting device with referring to the preset regulation parameters.

Compared with the prior regulation control techniques of air conditioning equipment, the regulation control system of air conditioning equipment of the present invention combines entrance guarding device and/or human body movement detecting device with air conditioning control device, and provides the air conditioning control device with data of air conditioning usage surroundings condition generated by the entrance guarding device and/or human body movement detecting device, and then the air conditioning control device executes regulation and control over the air conditioning equipment based on the data of air conditioning usage surroundings condition with referring to preset regulation parameters; accordingly, the air conditioning equipment is adjusted properly to a preset usage condition, thereby reaching objective of energy management of air conditioning equipment.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

First Embodiment

Figure 1:
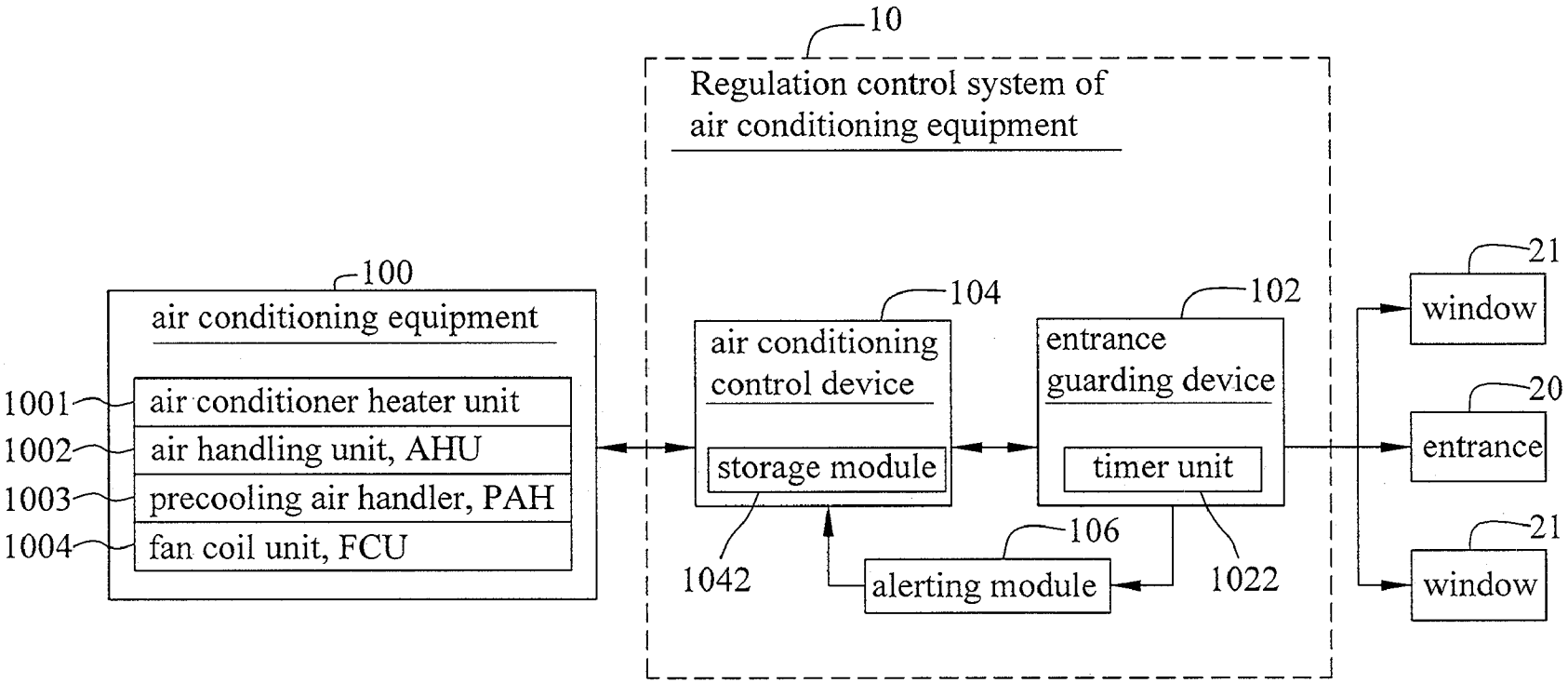
FIG. 1 is an application structure diagram of first embodiment of a regulation control system of air conditioning equipment of the present invention.

Please refer to FIG. 1, which is an application structure diagram of the first embodiment of a regulation control system of air conditioning equipment of the present invention. In the present embodiment, the regulation control system of air conditioning equipment 10 of the present invention is applicable to any air conditioning equipment 100 installed inside various kinds of buildings, especial large-scaled commercial places, such as office buildings, factory buildings, hotels, restaurants, hospitals, supermarket, wholesale stored, department stores, and so on; the air conditioning equipment 100 combines air conditioner heater unit 1001, air handling unit (AHU) 1002, precooling air handler (PAH) 1003, and fan coil unit (FCU) 1004.

It must be specifically stated herein, the air conditioning equipment 100 is not restricted to the aforesaid combination of air conditioner heater unit 1001, air handling unit (AHU) 1002, precooling air handler (PAH) 1003, and fan coil unit (FCU) 1004; it can be a part or parts of the combination.

The regulation control system of air conditioning equipment 10 of the present invention comprises an entrance guarding device 102, an air conditioning control device 104, and an alerting module 106.

The entrance guarding device 102 is for detecting usage condition of entrance 20 and windows 21, also the entrance guarding device 102 includes a timer unit 1022 that is for calculating time period of opening/closing at the entrance 20 and windows 21; and then data of air conditioning usage surroundings condition are generated based on detected condition of opening/closing, the data of air conditioning usage surroundings condition consists of condition and time period of opening/closing at entrance 20 and windows 21.

Specifically, the entrance guarding device 102 of the present embodiment can be an entrance guarding device that centrally detects usage conditions of entrance 20 and windows 21, and is for centrally detecting usage conditions of more than an entrance 20 and windows 21; in addition, the entrance guarding device 102 has one-way infrared detecting unit, two-way infrared detecting unit, electromagnetic switch, ultrasonic sensor unit and/or radio frequency identification (RFID) unit installed at each entrance 20 and windows 21, and condition of opening/closing at each of the entrances 20 and windows 21 is detected via at least one of the aforesaid units.

The air conditioning control device 104 includes a storage module 1042 that is for storing a set of preset regulation parameters corresponding to different data of air conditioning usage surroundings condition, and the air conditioning control device executes regulation and control over the air conditioning equipment 100 based on the data of air conditioning usage surroundings condition generated by the entrance guarding device 102 with referring to the preset regulation parameters.

In the present embodiment, the preset regulation parameters include the following contents:

A first regulation parameter, which is for adjusting room temperature of air conditioning equipment 100 up to a corresponding preset temperature each time when the timer unit 1022 calculates a time period of opening at entrance 20 and windows 21 reaching a first preset time period; for example, the first preset time period is preset as 5 minutes, and when the timer unit 1022 calculates that an entrance 20 or window 21 has been open for 5 minutes, preset temperature is raised one Celsius degree up, and 5 minutes later if the entrance or window is still open, the preset temperature is raised one Celsius degree up again.

A second regulation parameter, which is for turning off operation of air conditioning equipment each time when the timer unit 1022 calculates a time period of opening at entrance or window reaching a second preset time period; for example, the second preset time period is preset as 30 minutes, and when the timer unit 1022 calculates that an entrance 20 or window 21 has been open for 30 minutes, then the air conditioning equipment 100 is turned off.

A third regulation parameter, which overpowers the foresaid first and second regulation parameters and thus allows air conditioning equipment 100 to keep operating even when entrance 20 and/or windows 21 are open without the need of adjusting preset temperature; in other words, when entrance 20 and/or windows 21 are open, the third regulation parameter instructs the air conditioning equipment 100 to keep operating at present preset temperature, thus to keep room temperature in accordance with the preset temperature at present.

In order to be accord with a raised preset temperature, air conditioning equipment 100 can temporarily stop air conditioner heater unit 1001 or air handling unit 1002 from operating by increasing temperature preset at the air conditioner heater unit 1001 or air handling unit 1002, and the air conditioning equipment 100 begins to operate again and turns on the fan coil unit 1004 to get in outdoor fresh air when room temperature reaching the raised preset temperature; and it is based on the raised preset temperature and actual temperature of usage surroundings to decide if the precooling air handler 1003 is to be turned on and run, thereby regulating temperature of usage surroundings to be in accord with the raised preset temperature.

Alerting module 106, which generates an alerting message and then sends it to the air conditioning control device 104 each time when entrance 20 and/or windows 21 are open; in the present embodiment, the alerting message, which is generated by the alerting module 106 and then sent to the air conditioning control device 104 when entrance 20 and/or windows 21 are open, can further be used to inform management crew of the condition of opening/closing at the entrance 20 and/or windows 21.

Second Embodiment

Figure 2:
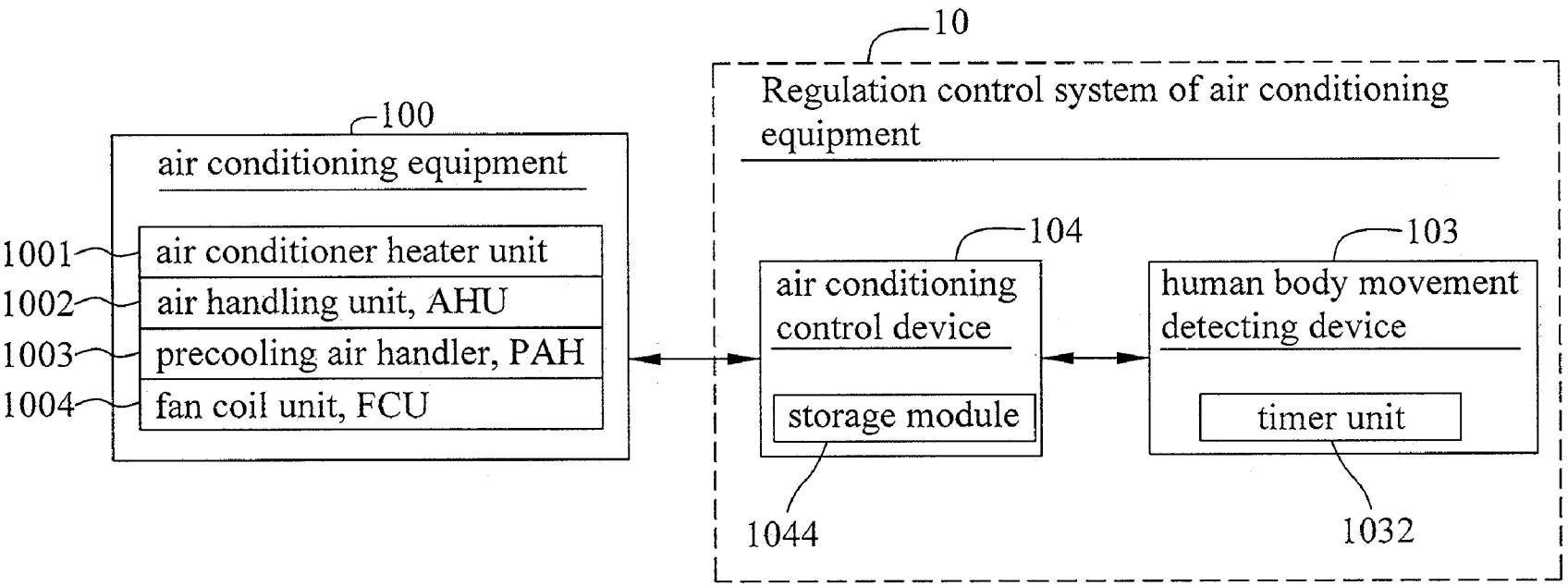
FIG. 2 is an application structure diagram of second embodiment of a regulation control system of air conditioning equipment of the present invention.

Please refer to FIG. 2, which is an application structure diagram of the second embodiment of a regulation control system of air conditioning equipment of the present invention; in the present invention, air conditioning equipment 100 is same as in the first embodiment; and the regulation control system of air conditioning equipment 10 of the present invention comprises a human body movement detecting device 103 and an air conditioning control device 104.

The human body movement detecting device 103 is for detecting usage condition that if users are inside the usage surroundings of air conditioning equipments; data of air conditioning usage surroundings condition are generated based on the detected usage condition; in the present embodiment, the human body movement detecting device 103 has a timer unit 1032, and the human body movement detecting device 103 is capable of verifying whether users are inside the surroundings of the air conditioning equipment by utilizing an infrared temperature induction unit, an image acquisition identification unit, and/or an audio perception unit.

The air conditioning control device 104, which includes a storage module 1044 that has a set of preset regulation parameters corresponding to different data of air conditioning usage surroundings condition, executes regulation and control over the air conditioning equipment 100 based on the data of air conditioning usage surroundings condition generated by the human body movement detecting device 103 with referring to the preset regulation parameters.

In the present embodiment, the preset regulation parameters may include the following contents:

A fourth regulation parameter, if users are in the usage surroundings of the air conditioning equipment 100, instructs to turn on operation of the air conditioning equipment 100.

A fifth regulation parameter, if no user is inside the usage surroundings of the air conditioning equipment 100, instructs to turn off operation of the air conditioning equipment 100.

The sixth regulation parameter, which instructs to turn off operation of the air conditioning equipment 100 only if there is no user inside the usage surroundings of the air conditioning equipment 100 and also the timer unit 1032 calculates a time period of condition that indicates no user is inside the usage surroundings of the air conditioning equipment 100 reaching a third preset time period.

Third Embodiment

Figure 3:
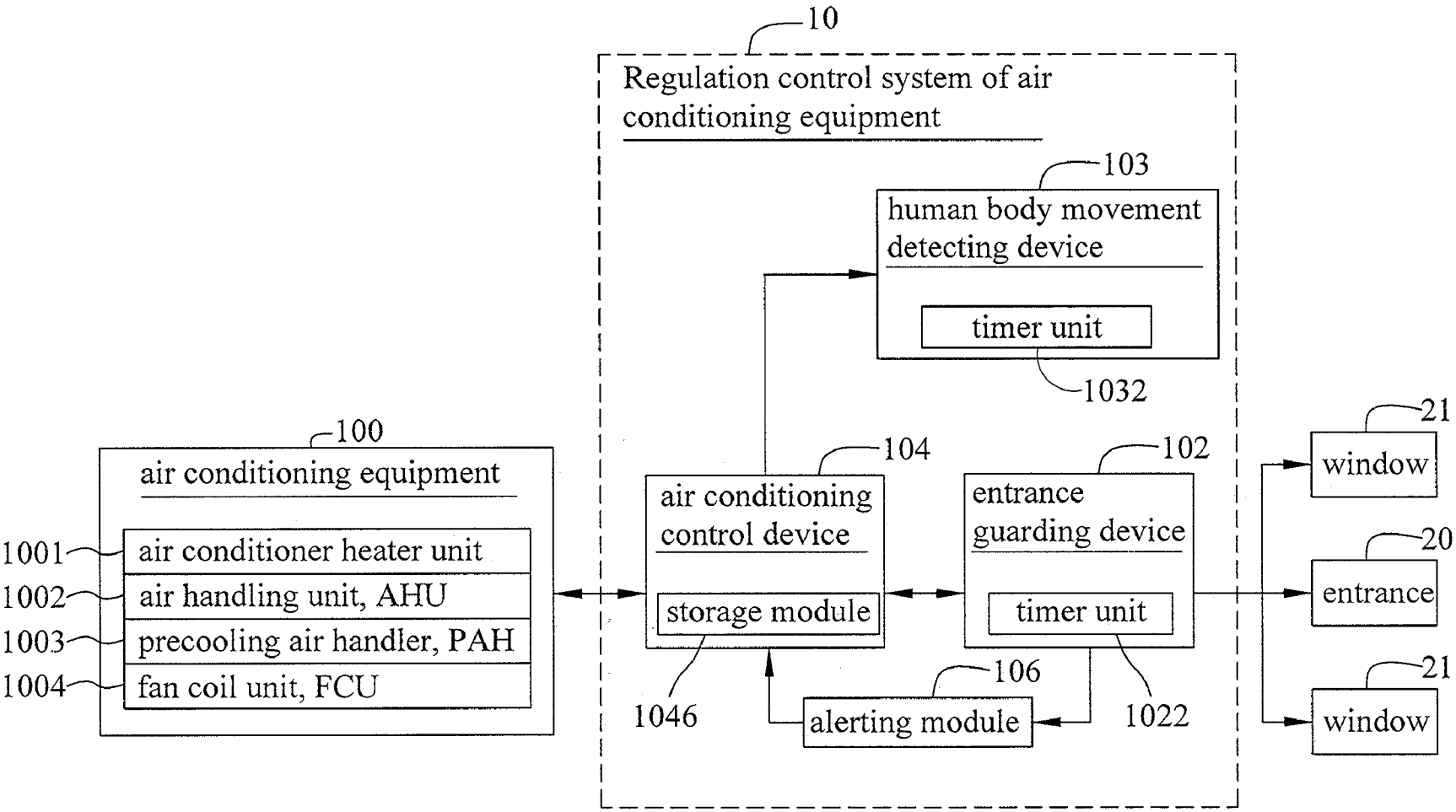
FIG. 3 is an application structure diagram of third embodiment of a regulation control system of air conditioning equipment of the present invention.

Please refer to FIG. 3, which is an application structure diagram of the third embodiment of a regulation control system of air conditioning equipment of the present invention; air conditioning equipment of the present embodiment is the same as in the first and second embodiments; and the regulation control system of air conditioning equipment of the present invention comprises an entrance guarding device 102, a human body movement detecting device 103, an air conditioning control system 104 and an alerting module 106.

Wherein, the entrance guarding device 102, the human body movement detecting device 103, and the alerting module 106 are the same as in the first and second embodiments, therefore, it is no need of repetitive descriptions herein.

The air conditioning control system 104, which includes a storage module 1046 that stores a set of preset regulation parameters corresponding to different data of air conditioning usage surroundings condition, executes regulation and control over the air conditioning equipment 100 based on the data of air conditioning usage surroundings condition generated by the entrance guarding device 102 and/or the human body movement detecting device 103 with referring to the preset regulation parameters.

In the present embodiment, the preset regulation parameters include the first regulation parameter through the sixth regulation parameter of the foresaid first and second embodiments, relations among the first regulation parameter through the sixth regulation parameter can be of intersection, union, and/or difference sets.

In view of the above, the regulation control system of air conditioning equipment of the present invention combines entrance guarding device and/or human body movement detecting device and air conditioning control device, and provides the air conditioning equipment with data of air conditioning usage surroundings condition generated by the entrance guarding device and/or human body movement detecting device, and the air conditioning control device is capable of regulating and controlling over the air conditioning equipment based on the data of air conditioning usage surroundings condition with referring to preset regulation parameters; accordingly, the air conditioning equipment is regulated to a preset usage condition, thereby reaching objective of energy management of air conditioning equipment.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A regulation control system of air conditioning equipment, which is for regulating and controlling air conditioning equipments; the regulation control system of air conditioning equipment comprises:

an entrance guarding device, which is for detecting usage condition of entrance or windows; the entrance guarding device has a timer unit that is for calculating time period of opening/closing at the entrance or windows, also the entrance guarding device generates data of air conditioning usage surroundings condition based on detected condition of opening/closing, the data of air conditioning usage surroundings condition include condition and time period of opening/closing at the entrance or windows; and an air conditioning control device, which includes a storage module that is for storing a set of preset regulation parameters corresponding to different data of air conditioning usage surroundings condition, and the air conditioning control system is capable of executing regulation and control over the air conditioning equipment based on the data of air conditioning usage surroundings condition generated by the entrance guarding device with referring to the preset regulation parameters, wherein the preset regulation parameters consist of:

a first regulation parameter, which is for raising temperature of usage surroundings of the air conditioning equipment up to a corresponding preset temperature each time when the timer unit calculates a time period of opening at the entrance or windows reaching a first preset time period;

a second regulation parameter, which is for turning off operation of the air conditioning equipment when the timer unit calculates a time period of opening at the entrance or windows reaching a second preset time period; and a third regulation parameter, which overpowers the first and the second regulation parameters, and allows the air conditioning equipment operating without adjusting the preset temperature when the entrance or windows are open.

2. The regulation control system of air conditioning equipment of claim 1, wherein, further comprises an alerting module, which generates an alerting message and then sends it to the air conditioning control device when the entrance or windows are open.

3. The regulation control system of air conditioning equipment of claim 1, wherein, the air conditioning equipment combines air conditioner heater unit, air handling unit, precooling air handler, or fan coil unit.

4. The regulation control system of air conditioning equipment of claim 1, wherein, the entrance guarding device detects conditions of opening/closing at the entrance or windows by utilizing an one-way infrared detecting unit, a two-way infrared detecting unit, an electromagnetic switch, an ultrasonic sensor unit, or a radio frequency identification (FRID) unit.

5. A regulation control system of air conditioning equipment, which is for regulating and controlling air conditioning equipments; the regulation control system of air conditioning equipment comprises:

an entrance guarding device, which is for detecting usage condition of entrance or windows, the entrance guarding device has a timer unit that is for calculating time period of opening/closing at the entrance or windows, also the entrance guarding device generates data of air conditioning usage surroundings condition based on detected condition of opening/closing; and the data of air conditioning usage surroundings condition include condition and time period of opening/closing at the entrance or windows;

a human body movement detecting device, which is for detecting usage condition that whether users are in the usage surroundings of the air conditioning equipment, and the human body movement detecting device generates data of air conditioning usage surroundings condition based on the detected usage condition; and an air conditioning control device, which includes a storage module that stores a set of preset regulation parameters corresponding to different data of air conditioning usage surroundings condition; the air conditioning control device executes regulation and control over the air conditioning equipment based on data of air conditioning usage surroundings condition derived from the entrance guarding device or human body detecting device with referring to the preset regulation parameters, wherein, the human body movement detecting device also has a timer unit, and the preset regulation parameters includes:

a first regulation parameter, which is for raising surrounding temperature of the air conditioning equipment up to a corresponding preset temperature each time when the timer unit calculates a time period of opening at the entrance or windows reaching a first preset time period;

a second regulation parameter, which is for turning off operation of the air conditioning equipment each time when the timer unit calculates a time period of opening at the entrance or windows reaching a second preset time period;

a third regulation parameter, which overpowers the first and the second regulation parameters, and allows the air conditioning equipment to keep operating without adjusting the preset temperature when the entrance or windows are open;

a fourth regulation parameter, which turns on operation of the air conditioning equipment when there are users inside the usage surroundings of the air conditioning equipment;

a fifth regulation parameter, which turns off the air conditioning equipment when there is no user inside the usage surroundings of the air conditioning equipment; and a sixth regulation parameter, which turns off the air conditioning equipment only when there is no user inside the usage surroundings of the air conditioning equipment and also the timer unit calculates a time period of condition of no user reaching a third preset time period.

6. The regulation control system of air conditioning equipment of claim 5, wherein, relations among the first regulation parameter through the sixth regulation parameter can be of intersection, union, or difference sets.

7. The regulation control system of air conditioning equipment of claim 5, wherein, further comprises an alerting module, which generates an alerting message and then sends it to the air conditioning control device when the entrance or windows are open.

8. The regulation control system of air conditioning equipment of claim 5, wherein, the air conditioning equipment combines air conditioner heater unit, air handling unit, precooling air handler, or fan coil unit.

9. The regulation control system of air conditioning equipment of claim 5, wherein, the entrance guarding device detects condition of opening/closing at the entrance or windows by utilizing an one-way infrared detecting unit, a two-way infrared detecting unit, an electromagnetic switch, an ultrasonic sensor unit, or a radio frequency identification (FRID) unit.

10. The regulation control system of air conditioning equipment of claim 5, wherein, the human body movement detecting device is capable of verifying if users are inside the usage surroundings of the air conditioning equipment by utilizing an infrared temperature induction unit, an image acquisition identification unit, or an audio perception unit.

* * * * *